United States Patent [19]

Hardy et al.

[11] Patent Number: 4,538,484

[45] Date of Patent: Sep. 3, 1985

[54] POWER TORQUE WRENCH TOOL

[76] Inventors: Raymond D. Hardy, 7210 Princeton Rd., Rockwall, Tex. 75087; William E. Van Steenwyk, 4341 Shady La., Barnhart, Mo. 63012

[21] Appl. No.: 493,516

[22] Filed: May 11, 1983

[51] Int. Cl.[3] ..... B25B 17/00

[52] U.S. Cl. ..... 81/57.14; 81/57.3

[58] Field of Search ..... 81/57.11, 57.14, 57.3, 81/57

[56] References Cited

U.S. PATENT DOCUMENTS

| | | | |
|---|---|---|---|
| 2,366,859 | 1/1945 | Koza | 81/57.29 |
| 2,825,252 | 3/1958 | Roberts | 81/57.14 |
| 3,668,949 | 6/1972 | Walker | 81/57.13 |
| 3,709,072 | 1/1973 | Rogers | 81/57.29 |
| 4,098,151 | 7/1978 | Bliss | 81/57.3 |
| 4,179,955 | 12/1979 | Akiyoshi et al. | 81/57.11 |

FOREIGN PATENT DOCUMENTS

| | | | |
|---|---|---|---|
| 2230955 | 1/1974 | Fed. Rep. of Germany | 81/57.39 |

*Primary Examiner*—James L. Jones, Jr.

*Attorney, Agent, or Firm*—F. Travers Burgess

[57] ABSTRACT

A power torque wrench tool for applying tension to trusses of the type used in coal mines, consisting of a pair of parallel rods with their adjacent end portions passing through parallel apertures in a truss rod attaching block and threaded at their ends to permit nuts to be attached to their respective ends at opposite ends of the attaching block for holding the truss rods in tensile relationship with each other at a predetermined tension, comprises an elongated body having a notch at one end to receive the rod adjacent to that on which a nut is to be tightened, a nut receiving socket rotatably journaled in the housing, a rotary hydraulic motor with its rotor rotatably journaled in the housing and operatively connected to the wrench to rotate the same, a pair of handles projecting downwardly from the bottom of the housing and an upwardly inclined extension on the side of the housing remote from the alignment notch for reacting engagement with the roof of the mine during operation of the device, the socket extending entirely through the body of the tool to permit the passage through the tool of the truss rod mounting the nut.

1 Claim, 5 Drawing Figures

POWER TORQUE WRENCH TOOL

BACKGROUND OF THE INVENTION

1. Field of the Invention

The invention relates to torque wrench tools and consists particularly in a power-drive torque wrench tool for applying predetermined tension to tods such as coal mine roof trusses having their adjacent end portions parallel to each other.

2. The Prior Art

Power driven socket wrenches are well known, but applicants are unaware of any having specific adaptability to the application of predetermined tension to rods arranged like the parallel rods of coal mine roof trusses.

SUMMARY OF THE INVENTION

The invention provides a simple, sturdy and highly effective, but easily held and controlled device for one-man operation to apply predetermined tension to elongated tension members comprising rods having their adjacent end portions parallel to each other, such as the rods forming the tension members of some coal mine roof trusses.

DETAILED DESCRIPTION OF THE INVENTION

Figure 1:
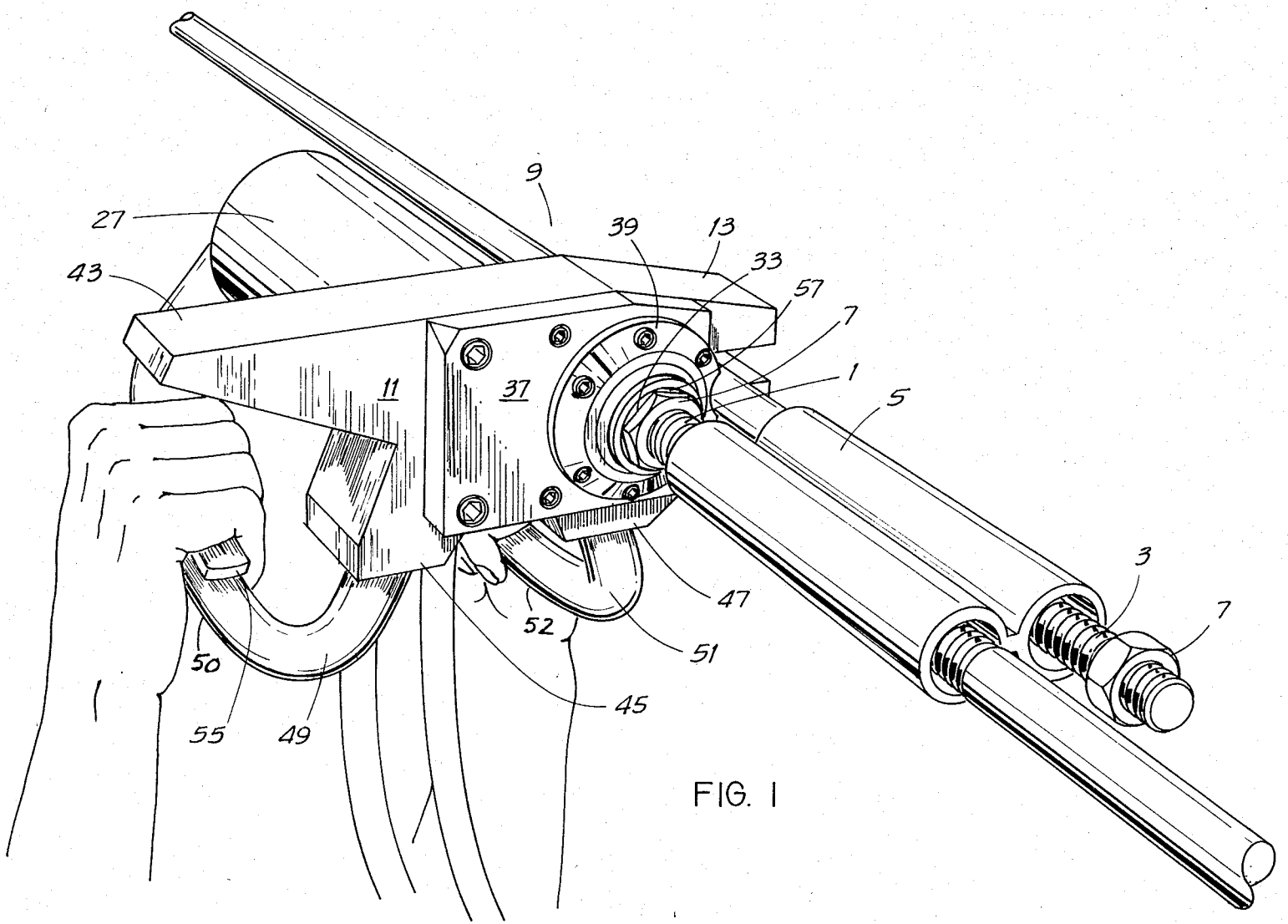
FIG. 1 is a perspective view of a tool embodying the invention in operative position showing adjacent parts of a coal mine roof truss.
Figure 2:
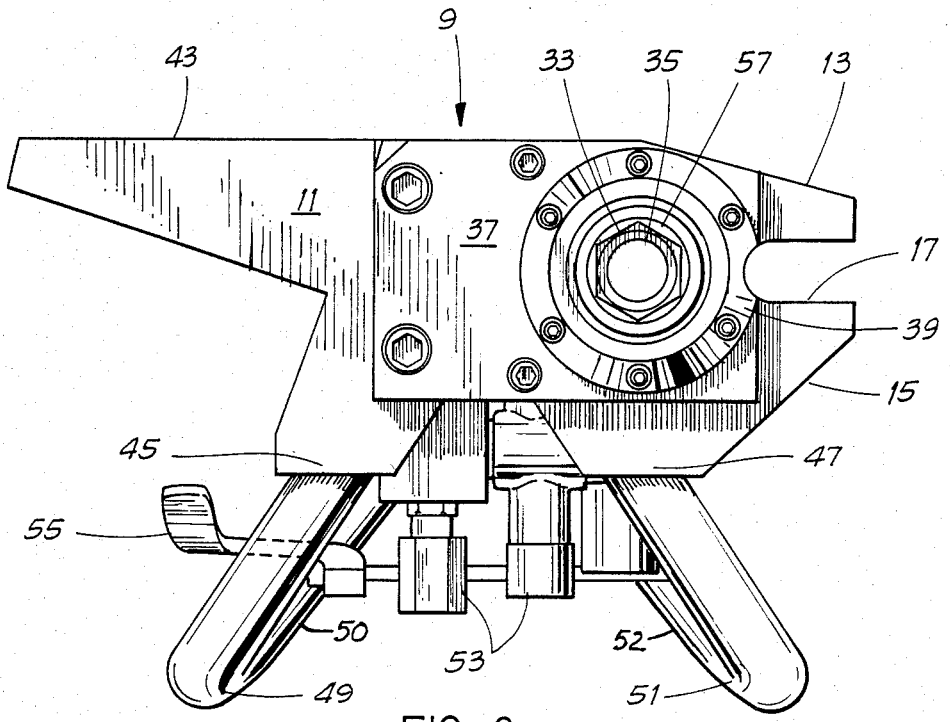
FIG. 2 is a front elevational view of the tool.
Figure 3:
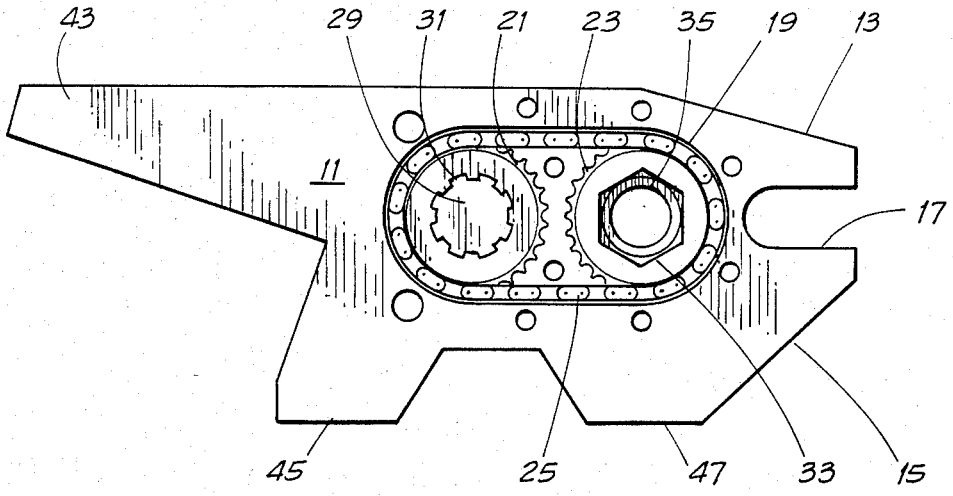
FIG. 3 is a frontal view of the tool frame with the cover plate removed.
Figure 4:
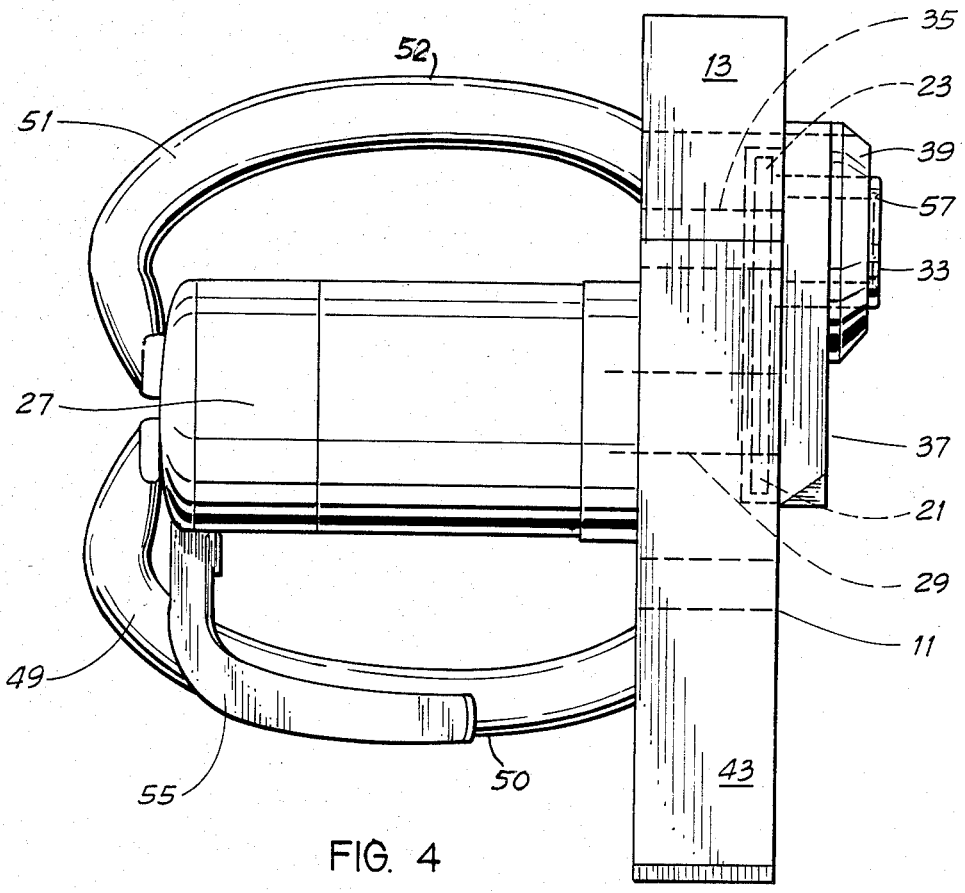
FIG. 4 is a top view of the tool.
Figure 5:
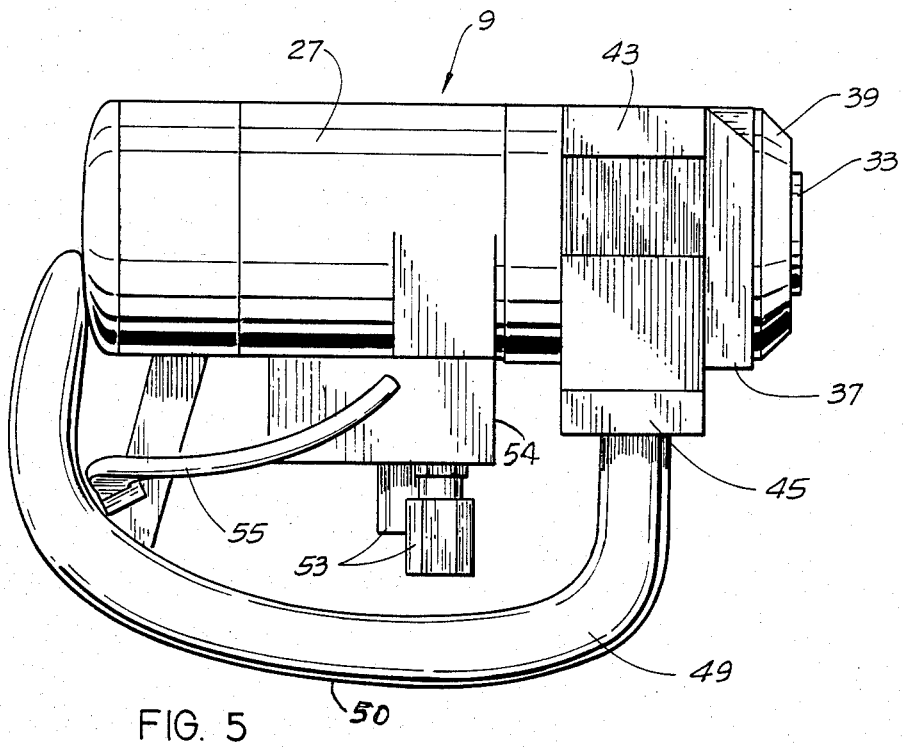
FIG. 5 is a side elevational view of the tool.

Referring to the drawings, numerals 1 and 3 refer to oppositely directed threaded end portions of truss rods of the type used for supporting mine roofs and the numeral 5 refers to a double sleeve connector through which the threaded end portions 1 and 3 extend so that nuts 7 tightened on the projecting ends of the respective truss rods against the adjacent end surfaces of the connector 5 hold the truss rods in assembled relation with each other and apply tension to the connected truss.

For securing the nuts 7 on truss rod end portions 1 and 3 and applying the proper tension to the assembled truss, a tool generally indicated at 9 comprises a plate frame 11 having generally tapered top and bottom edges 13 and 15 at one end and a substantially horizontal notch 17 projecting inwardly from the same side of the frame and being of sufficient width to slidably receive one of the truss rod end portions 1 or 3 to permit alignment of the tool with the adjacent truss rod. Adjacent the inner end of aligning notch 17, frame 11 is formed with a horizontally oriented oval cavity 19 in which are received a pair of sprockets 21 and 23 connected by a roller chain 25 so that rotation of sprocket 21 produces corresponding rotation of sprocket 23 and a hydraulic motor 27 is mounted on the rear face of plate frame 11 with its shaft 29 projecting through plate frame 11 and being splined as at 31 for connection to sprocket 21, such that when motor 27 operates sprocket 21 causing corresponding rotation of sprocket 23 to which is secured a hexagonal socket 33 engageable with nuts 7 for rotating the same, socket 33 is provided with a through aperture 35 to permit the projection through the tool of the respective truss rod 1 or 3 during tightening of the nut 7 thereon.

For maintaining the tool in assembled relation, a cover plate 37 is suitably secured to the front of frame 11 and is formed with a raised collar portion 39 centrally apertured to permit the projection therethrough of socket 33. At the side of the tool remote from alignment notch 17, frame 11 is formed with an outward and upward extension 43 adapted for abutment at its extremity with the roof of the mine tunnel to take reactions from the tightening torque applied by socket 33 to the respective nuts 7. For resting the tool when not in use, the bottom of the frame is formed with a pair of depending legs 45 and 47 and to assist the operator in lifting the tool into operating position and holding it in operating position during operation, the tool is provided with a pair of U-shaped handles 49 and 51 secured at their upper ends to the bottoms of legs 45 and 47 at one end and to the end of hydraulic motor 27 remote from frame 11. The intermediate portions 50 and 52 of handles 49 and 51 are generally parallel to the axes of the motor and socket and form hand grips for the operator of the tool. Suitable hydraulic connections 53 are provided and a valve device 54 mounted beneath the motor controls the admission of fluid to the motor. A control lever 55 mounted on one side of valve 54 adjacent handle 51 facilitates manual control of starting, stopping and speed of the motor. For expediting alignment of the socket and nut, the exposed face of the socket is formed with a chamfer 57.

Operation of the tool is as follows: After the double sleeve connector 5 has been placed on the parallel truss rods 1 and 3 and nuts 7 manually started on the threaded end portions of the truss rods projecting from connector 5, the operator of the tool grips intermediate portions 50 and 52 of handles 49 and 51, positions the tool with alignment slot 17 on the remote truss rod, aligns socket 33 generally with nut 7 and rests projection 43 against the mine roof, after which he moves control lever 55 to start motor 27 causing socket 33 to rotate so that nut 7 is seated in it, reception of nut 7 in socket 33 being facilitated by chamfer 57. As motor 27 continues to rotate socket 33 by means of sprockets 21 and 23 and roller chain 25, nut 7 is secured at the desired position on truss rod 1, after which the tool is applied to the nut on truss rod 3 in the same manner until nuts 7 tightly abut connector 5. The operator then releases control lever 55 to deenergize motor 27 and remove the tool from the assembled truss.

The details of the construction may be varied substantially without departing from the spirit of the invention and the exclusive use of those modifications as come within the scope of the appended claims is contemplated.

We claim:

1. A tool for securing a nut to one of a pair of parallel rods of a Birmingham Roof Truss comprising a plate-like frame, a nut-receiving socket rotatably mounted in said frame with its axis normal to the general plane of said frame, a motor mounted on said frame and having its shaft operatively connected to said socket whereby to produce rotation of the latter when said motor is energized, a notch in one end of said frame for receiving the other rod and thus aligning the socket axially with the one rod, said notch being spaced radially from the axis of said socket substantially the same distance as the space between the rods and being of sufficient width to slidably embrace the other rod when the socket is aligned axially with the one rod;

a circular aperture being formed through said frame in axial alignment with said socket to permit projection of the one rod through said frame as the nut is tightened;

the end of said frame remote from said notch being extended to provide a torque resisting abutment for engagement with a fixed surface generally parallel to the plane containing the axes of the parallel rods;

the mouth of said socket being chamfered to facilitate engagement of said socket with a nut;

the mouth of said socket being open to one face of said frame and said motor being secured to the opposite face of said frame with its output shaft parallel to the axis of said socket;

said frame being formed with a central recess receiving said motor shaft and said socket and containing torque transmitting means operatively connecting said motor shaft and said socket;

said torque transmitting means comprising a first sprocket on said motor shaft and a second sprocket rotatably mounted in said frame and mounting said socket;

an endless chain drivingly connecting said sprockets;

a cover plate enclosing said recess and removably secured to said frame;

a pair of diverging handles secured to said frame and having handgrip portions substantially parallel to the axis of said socket;

said diverging handles being of generally U-shape and being secured at their respective terminals to said frame and said motor with the handgrip portions thereof spaced apart a greater distance than the respective terminals;

control means for said motor having manual actuating means adjacent one of said handles;

said motor being a hydraulic motor, said control means comprising a valve, and said manual actuating means comprising a lever which is substantially parallel to the adjacent handgrip portion for regulating said valve by a user while holding the tool in position by both handles against the roof of a mine.

* * * * *